US011199309B1

(12) United States Patent
Benecke et al.

(10) Patent No.: US 11,199,309 B1
(45) Date of Patent: Dec. 14, 2021

(54) TECHNOLOGIES FOR DIRECTED ILLUMINATION

(71) Applicant: Watchfire Signs, LLC, Danville, IL (US)

(72) Inventors: Arnie Benecke, Danville, IL (US); Byron Hall, Danville, IL (US)

(73) Assignee: Watchfire Signs, LLC, Danville, IL (US)

( * ) Notice: Subject to any disclaimer, the term of this patent is extended or adjusted under 35 U.S.C. 154(b) by 0 days.

(21) Appl. No.: 16/900,377

(22) Filed: Jun. 12, 2020

(51) Int. Cl.

| | |
|---|---|
| ***F21V 11/06*** | (2006.01) |
| ***G09F 9/33*** | (2006.01) |
| ***F21V 7/00*** | (2006.01) |
| ***F21V 23/00*** | (2015.01) |
| *F21Y 115/10* | (2016.01) |

(52) U.S. Cl.
CPC ..... *F21V 11/06* (2013.01); *F21V 7/0008* (2013.01); *F21V 23/005* (2013.01); *G09F 9/33* (2013.01); *F21Y 2115/10* (2016.08)

(58) Field of Classification Search
CPC ..... F21V 11/06; F21V 23/005; F21V 7/0008; G09F 9/33; F21Y 2115/10
See application file for complete search history.

(56) References Cited

U.S. PATENT DOCUMENTS

| | | | | |
|---|---|---|---|---|
| 5,949,581 | A * | 9/1999 | Kurtenbach | G09F 27/008 359/621 |
| 7,907,133 | B2 * | 3/2011 | Joffer | G09G 3/2003 345/204 |
| 8,111,208 | B2 * | 2/2012 | Brown | G09F 9/3026 345/1.3 |
| 8,350,788 | B1 * | 1/2013 | Nearman | G09F 27/008 345/83 |
| 9,052,085 | B2 * | 6/2015 | Chan | F21V 17/10 |
| 9,607,533 | B1 * | 3/2017 | Qi | G09F 7/002 |
| 10,061,553 | B2 * | 8/2018 | Hall | G06F 3/1446 |
| 2016/0307476 | A1 * | 10/2016 | Cox | G09F 15/0012 |
| 2018/0130385 | A1 | 5/2018 | Qian et al. | |

* cited by examiner

*Primary Examiner* — Evan P Dzierzynski
(74) *Attorney, Agent, or Firm* — Dentons US LLP

(57) ABSTRACT

Generally, this disclosure enables various technologies for directed illumination. For example, this disclosure enables a sign (e.g., an electronic billboard) having a louver board with a plurality of brims and a plurality of channel groups, where the brims one-to-one shade the channel groups.

23 Claims, 9 Drawing Sheets

Restricted View Using Wall of Thru Hole 300

Frontal View of Louver Board 106

TECHNOLOGIES FOR DIRECTED ILLUMINATION

TECHNICAL FIELD

This disclosure relates to signage.

BACKGROUND

An electronic billboard can be configured to output a visual content (e.g., advertisements, municipal announcements, sports scores, stock quotes) therefrom. If the electronic billboard is positioned sufficiently close to a residential neighborhood, then the visual content may be optically disruptive to the residential neighborhood (e.g., causing light pollution, compromising residential health, interfering with local ecosystems, spoiling local aesthetics). Resultantly, the electronic billboard may not be permitted to operate from that location.

SUMMARY

Generally, this disclosure enables various technologies for directed illumination. For example, this disclosure enables a sign (e.g., an electronic billboard) having a louver board with a plurality of brims and a plurality of channel groups, where the brims one-to-one shade the channel groups.

An embodiment can include an outdoor sign comprising: a tray; a circuit board hosting an array of illumination groups, wherein each of the illumination groups contains a first light source, a second light source, and a third light source that are optically different from each other; and a louver board hosting an array of channel groups and an array of brims, wherein the circuit board extends between the tray and the louver board, wherein each of the channel groups contains a first channel, a second channel, and a third channel, wherein at least one of the brims is vertically positioned between at least two of the channel groups, wherein at least one of the channel groups is vertically positioned between at least two of the brims, wherein the brims one-to-one shade the channel groups, wherein the first light source is configured to illuminate from within the first channel, wherein the second light source is configured to illuminate from within the second channel, wherein the third light source is configured to illuminate from within the third channel.

An embodiment can include a method comprising: extending a circuit board between a tray and a louver board, wherein the circuit board hosts an array of illumination groups, wherein each of the illumination groups contains a first light source, a second light source, and a third light source that are optically different from each other, wherein the louver board hosts an array of channel groups and an array of brims, wherein each of the channel groups contains a first channel, a second channel, and a third channel, wherein at least one of the brims is vertically positioned between at least two of the channel groups, wherein at least one of the channel groups is vertically positioned between at least two of the brims, wherein the brims one-to-one shade the channel groups, wherein the first light source is configured to illuminate from within the first channel, wherein the second light source is configured to illuminate from within the second channel, wherein the third light source is configured to illuminate from within the third channel; and securing the louver board and the tray to each other such that the circuit board is interposed therebetween.

An embodiment can include a method comprising: causing a sign to be secured to an outdoor fixture, wherein the sign includes a tray, a circuit board, and a louver board, wherein the circuit board hosts an array of illumination groups, wherein each of the illumination groups contains a first light source, a second light source, and a third light source that are optically different from each other, wherein the louver board hosts an array of channel groups and an array of brims, wherein the circuit board extends between the tray and the louver board, wherein each of the channel groups contains a first channel, a second channel, and a third channel, wherein at least one of the brims is vertically positioned between at least two of the channel groups, wherein at least one of the channel groups is vertically positioned between at least two of the brims, wherein the brims one-to-one shade the channel groups, wherein the first light source is configured to illuminate from within the first channel, wherein the second light source is configured to illuminate from within the second channel, wherein the third light source is configured to illuminate from within the third channel; and causing the illumination groups to illuminate while the sign is secured to the outdoor fixture.

An embodiment can include a sign comprising: a tray; a circuit board hosting an array of illumination groups, wherein each of the illumination groups contains a plurality of light sources; and a louver board hosting an array of channel groups and an array of brims, wherein the circuit board extends between the tray and the louver board, wherein each of the channel groups contains a plurality of channels, wherein at least one of the brims is vertically positioned between at least two of the channel groups, wherein at least one of the channel groups is vertically positioned between at least two of the brims, wherein the brims one-to-one shade the channel groups, wherein the light sources are configured to illuminate from within the channels.

DETAILED DESCRIPTION

Figure 1:
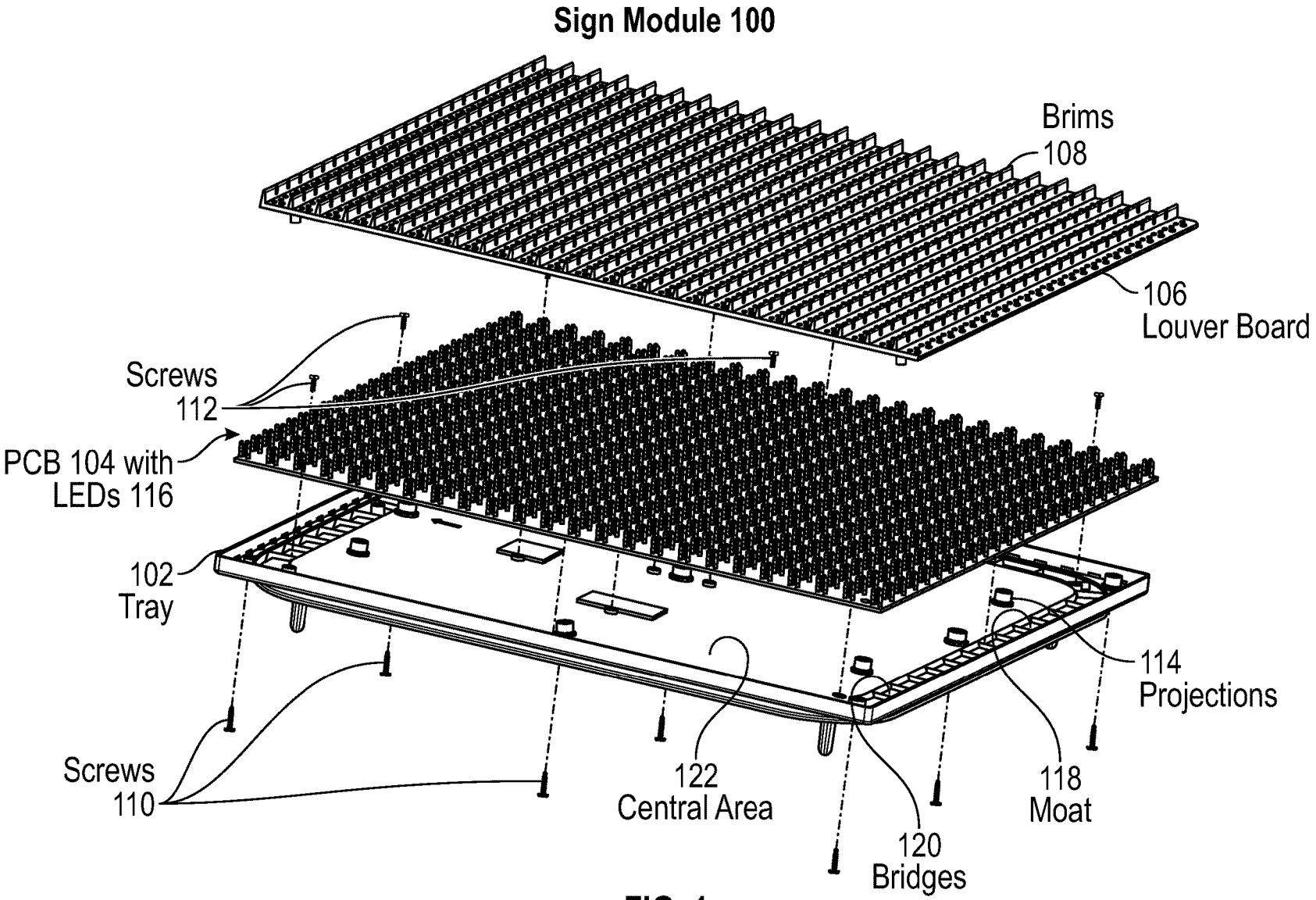
FIG. 1 shows an exploded view of an embodiment of a sign module according to this disclosure.

Generally, this disclosure enables various technologies for directed illumination. For example, this disclosure enables a sign (e.g., an electronic billboard) having a louver board with a plurality of brims and a plurality of channel groups, where the brims one-to-one shade the channel groups. For example, the sign can be made from a plurality of module blocks arranged in an array. Each of the module blocks can include a plurality of light sources arranged in a plurality of illumination groups, where each of the illumination groups include at least two of the light sources. For example, there can be at least three light sources (e.g., red light source, green light source, blue light source) corresponding to a pixel. Each of the pixels can be designed to be viewed from each side (e.g., +/−within about 180 degrees) and from below down a minimum of about 45 degrees. Each of the module blocks can include the louver board that hosts the brims that blocks or reduces viewing intensity on one side (e.g., left or right horizontally). For example, over the last few years, there has been noticed an increased demand for a light-blocking light emitting diode (LED) sign. This demand appears to come from zoning and permitting of LED signs, primarily in residential neighborhoods that are sensitive to light pollution. A common scenario includes an LED billboard installed on a highway that sits adjacent to a residential neighborhood. The billboard is positioned such that a portion of the billboard faces a residential property. Some amount of light will be visible by residents looking in a direction of the billboard and from light reflecting off houses and structures in the residential neighborhood. Permitting may be denied by a municipality for the billboard due to resident complaints. Having a light blocking sign product addresses these concerns of the residents and improving chances for permits to be granted to billboard operators. Horizontal viewing of an LED sign is typically specified by a half-brightness point of the LEDs. Once an observer is beyond the half-brightness point, there's no guarantee that an image or text displayed on the image will be perceivable. Even though the image may not be perceivable, in many cases light is emitted all the way out to 180 degrees on a diminishing curve. Therefore, the louver board can intentionally restrict at least some light output of an LED sign, at some point or points within operational limits of the LEDs used in the sign. This can be done by positioning the brims over the channel groups and nesting the LEDs inside the channel groups, where the louver board can attach to a pre-assembled plastic tray and a printed circuit board with LEDs and other electrical components. The LEDs can be nested at different depths so that a desired horizontal viewing angle is achieved (e.g., between about 10 millimeters and about 20 millimeters). The louver board can have a plurality of chamfers that are constructed within the channel groups, underneath the LEDs so that the vertical viewing angle of the LEDs is maintained and stays within the operational limits of the LED's vertical viewing angle. These configurations enable the sign that will function symmetrically, viewed from either side of the sign. Likewise, these configurations simplify manufacturing, which can be used during injection molding and not having individual brims next to each LED, which can be small in wall thickness and size. Similarly, by nesting the LEDs inside the louver board, there is a wall is created around each of the LEDs and light can be reflected off these walls. Therefore, when viewing the sign off-angle, this light reflection can be seen. The wall may have a draft angle that can have an impact on how much light is reflected and the draft angle can be optimized as described herein (e.g., optimize the draft angle to limit how much light is reflected). If the LEDs are nested too far down (e.g., below a reflector cup of a through-hole LED), then there may be a significant cut down on the off-angle light output of the LEDs. Also, at least some underside ribbing (e.g., ridges, valleys) can be used to prevent at least some light from leaking out from pixel to pixel. The louver board can be manufactured in various ways (e.g., additive manufacturing, subtractive manufacturing). Some of these ways can includes injection molding, 3D printing, multi-jet fusion, or others. The louver board can include various materials (e.g., plastic, metal, rubber, non-glass filled polycarbonate, glass filled polycarbonate). However, note that this disclosure may be embodied in many different forms and should not be construed as necessarily being limited to various embodiments disclosed herein. Rather, these embodiments are provided so that this disclosure is thorough and complete, and fully conveys various concepts of this disclosure to skilled artisans.

Note that various terminology used herein can imply direct or indirect, full or partial, temporary or permanent, action or inaction. For example, when an element is referred to as being "on," "connected," or "coupled" to another element, then the element can be directly on, connected, or coupled to another element or intervening elements can be present, including indirect or direct variants. In contrast, when an element is referred to as being "directly connected" or "directly coupled" to another element, then there are no intervening elements present.

Although the terms first, second, can be used herein to describe various elements, components, regions, layers, or sections, these elements, components, regions, layers, or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

As used herein, various singular forms "a," "an" and "the" are intended to include various plural forms (e.g., two, three, four, five, six, seven, eight, nine, ten, tens, hundreds, thousands) as well, unless specific context clearly indicates otherwise.

As used herein, various presence verbs "comprises," "includes" or "comprising," "including" when used in this specification, specify a presence of stated features, integers, steps, operations, elements, or components, but do not preclude the presence or addition of one or more other features, integers, steps, operations, elements, components, or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

As used herein, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements.

Therefore, various example terms "below" and "lower" can encompass both an orientation of above and below.

As used herein, a term "about" or "substantially" refers to a +/−10% variation from a nominal value/term. Such variation is always included in any given value/term provided herein, whether or not such variation is specifically referred thereto.

FIG. 1 shows an exploded view of an embodiment of a sign module according to this disclosure. In particular, a sign module 100 is a modular component of a larger sign, which can be configured for outdoor use (e.g., weather-proof, rodent-proof, gasketed, flashed). For example, the sign with the sign module 100 can be positioned near (e.g., within about 1000 feet or less) a road (e.g., highway, local street) or a pedestrian walkway (e.g., sidewalk, boardwalk) such that an operator of or a passenger in a passing vehicle (e.g., car, truck, bus, motorcycle, bicycle) or a passing pedestrian can see the sign with the sign module 100. This would enable the sign with the sign module 100 to be an outdoor sign, although an indoor sign (e.g., within a building) is possible as well.

The sign can include at least two of the sign modules 100 (e.g., three, four, five, six, seven, eight, nine, ten, tens, hundreds, thousands), whether the sign modules 100 are identical or non-identical in shape, size, structure, function, thermal properties, electrical properties, or other related properties. For example, the sign can include the sign modules 100 arranged in a grid manner formed by a plurality of rows of the sign modules 100 and a plurality of columns of the sign modules 100. For example, the sign can include the sign modules 100 arranged in a rectilinear manner, although other shapes are possible (e.g., polygonal, circular, oval, triangular, pentagonal, octagonal). The sign module 100 includes a tray 102, a printed circuit board (PCB) 104, a louver board 106, a plurality of brims 108, a plurality of screws 110, and a plurality of screws 112.

The tray 102 includes a base and a plurality of sidewalls upwardly extending from the base such that an interior space is defined. The base and the sidewalls are monolithic, but can be assembled (e.g., mating, fastening, adhering). The base or the sidewalls can include plastic, metal, rubber, or other suitable materials. The base is square in shape, but other suitable shapes can be used (e.g., rectangular, polygonal, circular, oval, triangular, pentagonal, octagonal). The sidewalls are identical to each other in terms of dimensions (e.g., length, width, height, thickness, thermal properties, electrical properties, structural properties) and shape (e.g., square), but these dimensions or shape can suitably vary inclusive of size or scale.

The base hosts a central area 122 through which a plurality of tubular (or non-tubular) and hollow (or non-hollow) projections (e.g., bosses or PCB bosses that can function to fasten the PCB 104 to the tray 102 or vice versa) 114 are upwardly extending therefrom. The central area 122 and the projections 114 are positioned within the interior space and enclosed by the sidewalls. Within the interior space, the central area 122 is peripherally spaced apart from the sidewalls such that the central area 122 forms an island relative to the sidewalls with a moat 118 peripherally extending about the central area 122. The base hosts a plurality of bridges 120 spanning between the central area 122 and the sidewalls. Note that the tray 102 can also host other suitable and relevant devices (e.g., fans, heat sinks) or openings (e.g., vents).

The PCB 104 hosts a plurality of LEDs 116 thereon such that the LEDs 116 can be supported, controlled, and powered to output a plurality of lights (e.g., visible light, black light, infrared light), whether the lights are optically identical or non-identical to each other (e.g., color, luminosity). Note that the LEDs 116 are one illustrative form of a light source that can be used by the sign module 100. As such, other types of light sources can be used (e.g., bulbs, incandescent bulbs, LED bulbs, halogen bulbs, gas discharge lamps, gas discharge tubes, fluorescent bulbs, projectors, reflective mirrors), whether additionally or alternatively, whether identical or non-identical to each other in structure, function, optical properties, or other relevant properties.

The PCB 104 can be single-sided (e.g., one copper layer), double-sided (e.g., two copper layers on both sides of one substrate layer), or multi-layer (e.g., outer and inner layers of copper, alternating with layers of substrate). The PCB 104 mechanically supports and electrically connects (e.g., serial, parallel) the LEDs 116 using a plurality of conductive tracks, pads and other features etched from a sheet layer of copper laminated onto or between a plurality of sheet layers of a non-conductive substrate. The LEDs 116 can be soldered onto the PCB to both electrically connect and mechanically fasten the LEDs 116 thereto. Note that PCB 104 is not limiting and any circuit board, whether printed or not, can be used. Further, wire wraps or point-to-point construction can be used, whether additional or alternative to the PCB 104.

When the PCB 104 is inserted into or positioned within the interior space of the tray 102, as enclosed by the sidewalls, the LEDs 116 output the lights in a direction away from the base and the central area 11, whether the direction is identical or non-identical for the LEDs 116. For example, this direction can be perpendicular to the base or the central area 122. Also, the tray 102 can be omitted and another suitable supporting structure can be used (e.g., a frame, a platform, a wall) or the PCB 106 can be exposed to an ambient environment.

The PCB 104 is interposed or extends between the LEDs 116 and the base, the central area 122, or the projections 114. Further, the PCB 104 is interposed or extends between the sidewalls that oppose or face each other. The projections 114 can or can avoid contacting the PCB 104 within the interior space. The PCB 104 can extend or can avoid extending over the moat 118 or the bridges 120, as enclosed by the sidewalls.

The louver board 106 has an outer surface and hosts a plurality of brims (or shaders) 108 cantilevered or non-cantilevered extending from the outer surface, as disclosed herein. Such extension is perpendicular to the outer surface, but can be non-perpendicular as well, whether towards or away from a ground surface when the sign module 100 is installed (e.g., perpendicular to the ground surface). For example, such non-perpendicular extension can be inclusively angled within about 150 degrees relative to the outer surface, whether towards or away from the ground surface (e.g., positive or negative slope). The louver board 106 extends between the brims 108 and the PCB 104 (e.g., the LEDs 116) or the tray 102 (e.g., the base, the walls, the projections 114, the central area 122, the moat 118, the bridges 120). The PCB 104 extends between the brims 108 and the tray 102 (e.g., the base, the walls, the projections 114, the central area 122, the moat 118, the bridges 120).

The louver board 106 is monolithic, but can be assembled (e.g., mated, fastened, jigsaw puzzle). The louver board 106 includes a non-glass filled polycarbonate, but can include any other suitable material (e.g., plastic, metal, rubber, glass, wood). The brims 108 are monolithic with the louver board 106 (e.g., injection molding, subtractive manufacturing), but can be assembled with the louver board 106 (e.g., fastened, mated, magnetized, adhered). At least two of the brims 108 that are horizontally consecutive can be monolithic with each other (e.g., injection molding, subtractive manufacturing), but can be assembled with each other (e.g., fastened, mated, magnetized, adhered).

The PCB 104 is interposed or extends between the louver board 106 and the tray 102 (e.g., the base, the walls, the projections 114, the central area 122, the moat 118, the bridges 120). During such interposition or extension, the screws 112 extend through the PCB 104 and the tray 102 (e.g., the base, the walls, the projections 114, the central area 122, the moat 118, the bridges 120) and thereby secure the PCB 104 to the tray 102 or vice versa. The screws 112 can be inserted from the PCB 104 into the tray 102 (e.g., the base, the walls, the projections 114, the central area 122, the moat 118, the bridges 120) or vice versa. Likewise, during such interposition or extension, the screws 110 extend through the tray 102 (e.g., the base, the walls, the projections 114, the central area 122, the moat 118, the bridges 120), the PCB 104, or the louver board 106 and secure (a) the PCB 104 to the tray 102 or vice versa or (b) the louver board 106 to the tray 102 or vice versa, or (c) the louver board 106 to the PCB 104 or vice versa. The screws 110 can be inserted (a) from the tray 102 into the PCB 104 or the louver board 106 or (b) from the louver board 106 into the PCB or the tray 102 or (c) from the PCB 104 into the tray 102 or the louver board 106. For example, the tray 102 can be fastened to the louver board 106, which can be through the PCB 104.

Figure 2:
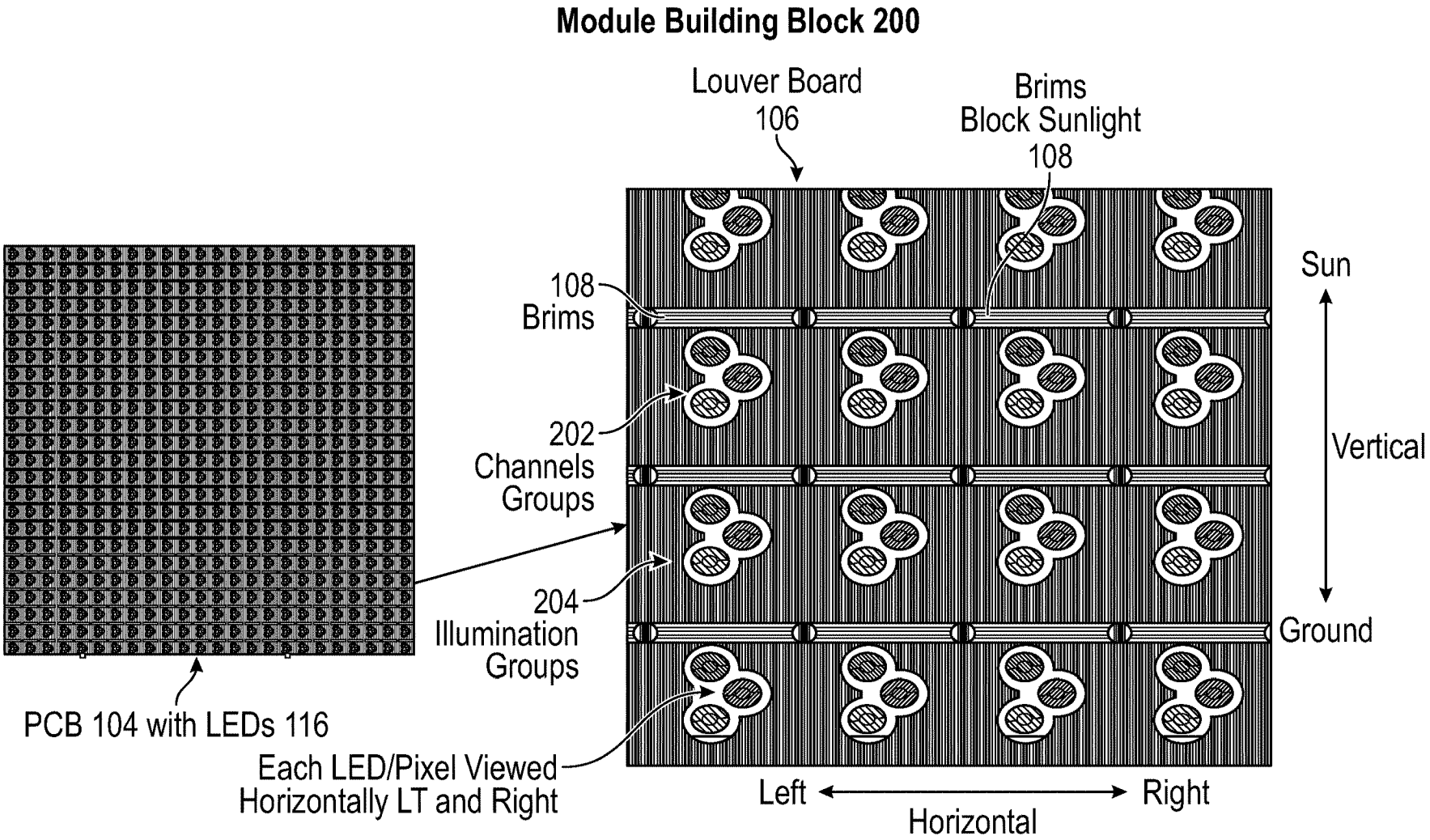
FIG. 2 shows a frontal view of an embodiment of a module building block according to this disclosure.

FIG. 2 shows a frontal view of an embodiment of a module building block according to this disclosure. In particular, the sign module 100 includes a module building block 200 that has the PCB 104 hosting the LEDs 116, as disclosed herein.

The LEDs 116 are positioned on the PCB 104 such that the LEDs 116 form an array of illumination groups 204, where each of the illumination groups 204 contains a plurality of the LEDs 116. Therefore, the array of illumination groups 204 is arranged in a grid having a plurality of rows of the illumination groups 204 and a plurality of columns of the illumination groups 204. The illumination groups 204 can be individually addressable within the array of illumination groups 204. For example, at least one of the illumination groups 204 can be individually addressable within the array of illumination groups 204 via a column identifier and a row identifier. However, note that this arrangement can vary, and the illumination groups can be positioned on the PCB 104 in any manner (e.g., a rectilinear line, an arcuate line, a polygon, a circle).

As shown, each of the illumination groups 204 includes three of the LEDs 116, which are structurally, functionally, or optically identical or non-identical to each other. However, note that variations are possible where at least some of the illumination groups 204 contain less than three of the LEDs 116 (e.g., two) or more than three of the LEDs 116 (e.g., four, five, six, seven, eight, nine, ten, tens, hundreds).

Each of the illumination groups 204 includes the LEDs 116 that output the lights in a plurality of optical properties that are different from each other (e.g., color, luminosity). For example, each of the illumination groups 202 includes a blue LED 116, a red LED 116, and a green LED 116. However, note that variations are possible where the lights can be output with the optical properties (e.g., color, luminosity) that are optically identical or non-identical to each other. For example, there can be orange, purple, or other color LEDs 116, whether identical or non-identical in brightness.

Each of the illumination groups 204 contains the LEDs 116 arranged in a particular shape manner (e.g., triangular). For example, each of the illumination groups 202 has the LEDs 116 arranged in a triangular manner such that the LEDs 116 function as a plurality of corresponding vertices of a corresponding triangle. However, note that such arrangement can vary and at least some of the illumination groups 202 have the LEDs 116 arranged in a non-triangular manner (e.g., a vertical rectilinear line, a horizontal rectilinear line, a diagonal rectilinear line, a circle, an oval, a polygon, a square, a rectangle, a pentagon, an octagon).

The louver board 106 includes the outer surface (e.g., exposed to Sun) and has the brims 108 cantilevered or non-cantilevered extending from the outer surface, as disclosed herein. Such extension is perpendicular to the outer surface, but can also be non-perpendicular, whether towards or away from the Sun or the ground surface when the sign module 100 is installed (e.g., perpendicular to the ground surface) outdoors. For example, such non-perpendicular extension can be inclusively angled within about 150 degrees relative to the outer surface, whether towards or away from the Sun or the ground surface (e.g., positive or negative slope) when the sign module 100 is installed outdoors.

The brims 108 extend from the louver board 106 such that the brims 108 form an array of brims 108. Therefore, the array of brims 108 is arranged in a grid having a plurality of rows of the brims 108 and a plurality of columns of the brims 108.

The louver board 106 defines a plurality of channels extending therethrough, whether identical or non-identical to each other with respect to dimensions, cross-section, directionality, or other relevant parameters. The channels are formed via a plurality of inner surfaces (e.g., smooth, textured, optically reflective, optically non-reflective) defining a plurality of corresponding openings. The channels are longitudinally rectilinear, but this can vary (e.g., arcuate). The channels have symmetrical cross-sections, but can have asymmetrical cross-sections.

The channels extend through the louver board 106 such that the channels form an array of channel groups 202. Therefore, the array of channel groups 202 is arranged in a grid having a plurality of rows of the channel groups 202 and a plurality of columns of the channel groups 202. As such, the array of brims 108 one-to-one corresponds to the array of channel groups 202 such that the brims 108 one-to-one shade the channel groups 202 (e.g., from sunlight) when the module building block 200 is positioned outdoors. Likewise, the illumination groups 204 one-to-one correspond to the channel groups 202 such that the LEDs 116 can illuminate from within the channels, as disclosed herein.

As shown, each of the channel groups 202 includes three channels one-to-one corresponding to the three LEDs 116 of that respective illumination group 204. Therefore, the three LEDs 116 can illuminate from within the three channels. However, note that this can vary. For example, there can be less than two channels within at least one of the channel groups 202 (e.g., two) or more than two channels within at least one of the channel groups 202 (e.g., four, five, six, seven, eight, nine, ten, tens, hundreds). Further, note that there can be one channel within at least one of the channel groups 202 through which at least two LEDs 116 can illuminate.

At least one of the brims 108 is vertically positioned between at least two of the channel groups 202. Likewise, at least one of the channel groups 202 is vertically positioned between at least two of the brims 108. This arrangement allows the brims 108 one-to-one vertically shade the channel groups 202, where the LEDs 116 illuminate from within the channels of the channel groups 202 through the openings of the channels, as disclosed herein.

Figure 3:
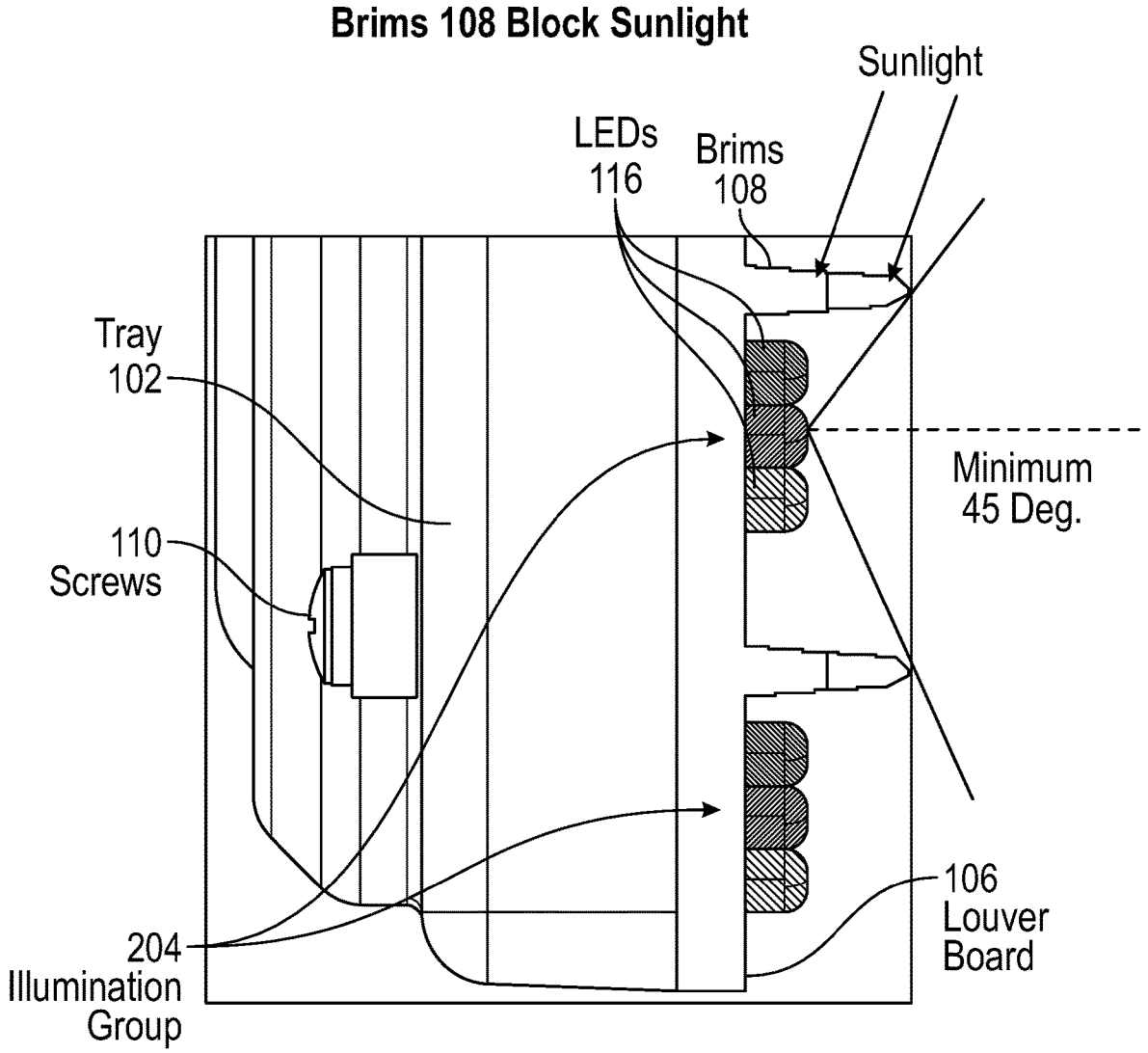
FIG. 3 shows a profile view of an embodiment of a brim shading a light source according to this disclosure.

FIG. 3 shows a profile view of an embodiment of a brim shading a light source according to this disclosure. In particular, the module building block 200 is illustrated in such a way to show how the brims 108 block at least some sunlight directed at the illumination group 204 when the module building block 200 is installed outdoors. The tray 102 may or may not be exposed to sunlight. The screws 110 may or may not be exposed to sunlight. At least one of the brims 108 is vertically positioned between at least two of the illumination groups 204. Note that although the brims 108 appear outwardly tapering away in thickness from the louver board 106, this is not required. As such, the brims 108 can be inwardly tapering in thickness toward the louver board 106 or be non-tapering (e.g., a uniform thickness).

Figure 4:
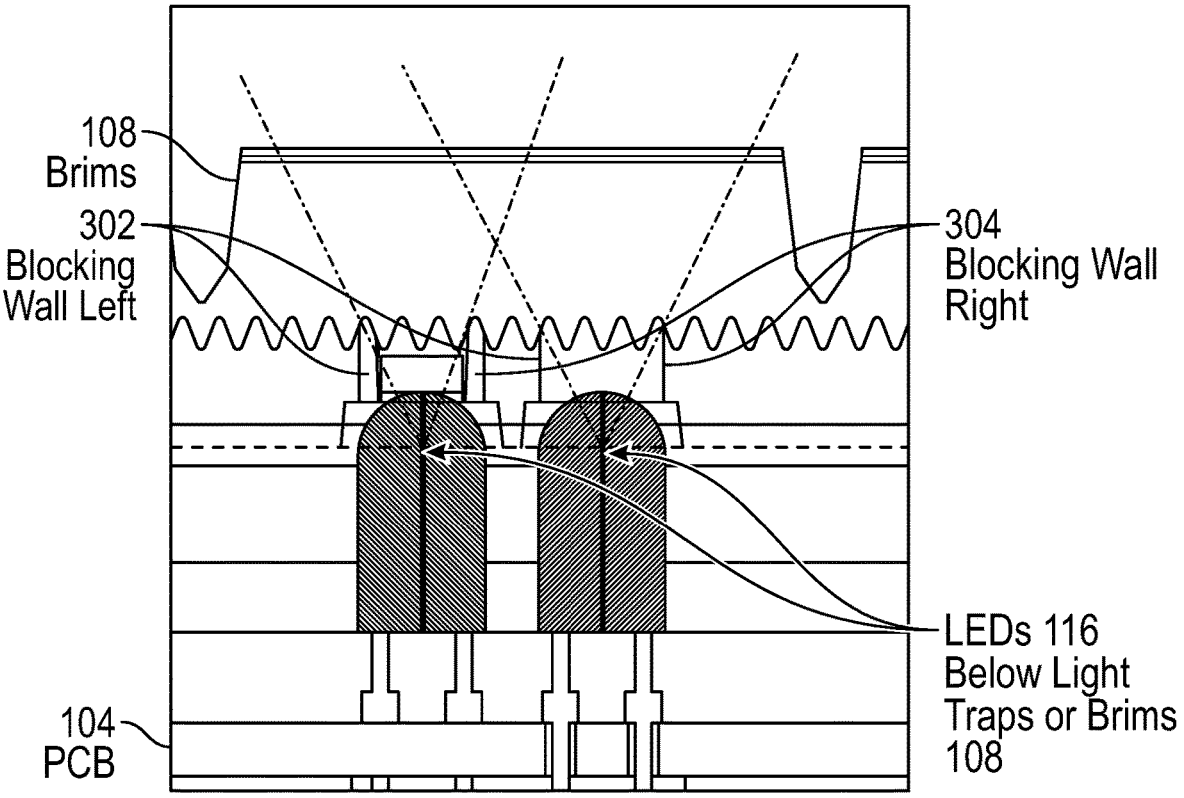
FIG. 4 shows a cross-sectional view of an embodiment of a channel according to this disclosure.

FIG. 4 shows a cross-sectional view of an embodiment of a channel according to this disclosure. In particular, the module building block 200 includes the PCB 104 hosting the LEDs 116 in one of the illumination groups 204, as disclosed herein. The channels of the channel groups 202 form the openings or a plurality of thru holes 300 defined via the inner surfaces, as disclosed herein. Each of the channels includes a left sidewall 302 and a right sidewall 304, where a respective LED 116 can be positioned therebetween, extend therebetween, or nested therebetween. Note that most (e.g., at least 51 percent) of that respective LED 116 does not longitudinally extend through that respective channel between the left sidewall 302 and the right sidewall 304, yet that respective LED 116 is frontally visible at a predetermined angle (e.g., equal or less than about 90, 80, 70, 60, 50, 40, 30, 20, 10 degrees) with a central optical axis of that respective LED 116 symmetrically splitting the predetermined angle into a pair of opposing equal lateral sub-angles (left and right). However, note that most (e.g., at least 51 percent) of that respective LED 116 can longitudinally extend through that respective channel between the left sidewall 302 and the right sidewall 304.

Figure 5:
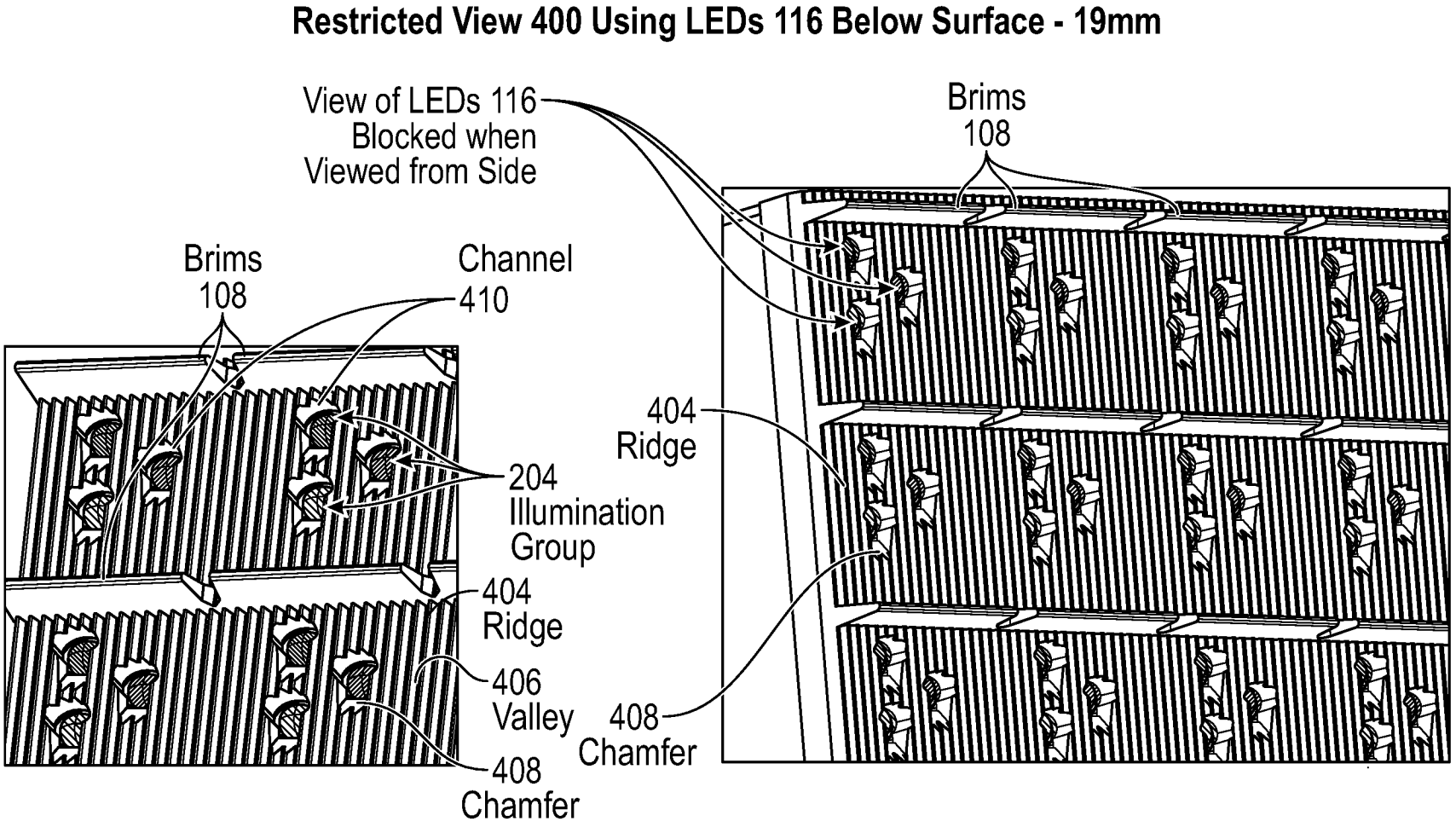
FIG. 5 shows a plurality of perspective views of a plurality of embodiments of a plurality of louver boards according to this disclosure.
Figure 6:
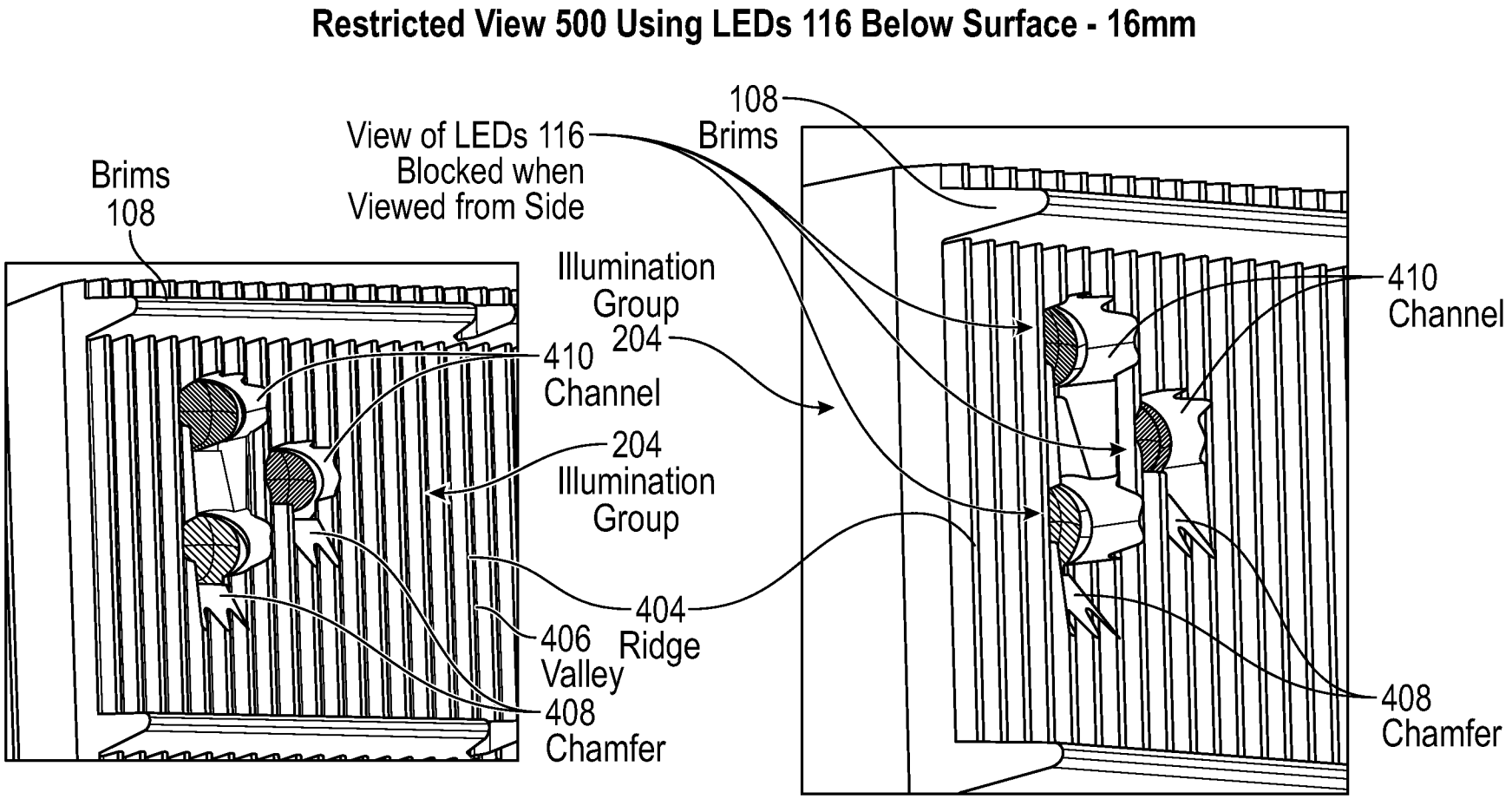
FIG. 6 shows a plurality of perspective views of a plurality of embodiment of a plurality of louver boards according to this disclosure.

FIG. 5 shows a plurality of perspective views of a plurality of embodiments of a plurality of louver boards according to this disclosure. FIG. 6 shows a plurality of perspective views of a plurality of embodiment of a plurality of louver boards according to this disclosure. In particular, the module building block 200 includes the PCB 104 hosting the LEDs 116 in the array of illumination groups 202 and the louver board 106 hosting the array of brims 108 and the array of channel groups 202, as disclosed herein. The array of brims 108 one-to-one shades the array of channel groups 202, as disclosed herein. The array of channel groups 202 one-to-one optically directs the array of illumination groups 204 such that a plurality of channels 410 of the illumination groups 204 optically direct illumination from the LEDs 116 nested within the channels 410 below the outer surface (e.g., between about 10 millimeters and about 20 millimeters). For example, the LEDs 116 can be mostly longitudinally extending outside the channels 410.

At least one of the brims 108 is vertically positioned between at least two of the channel groups 204 and at least one of the channel groups 204 is vertically positioned between at least two of the brims 108. The brims 108 one-to-one vertically shade the channel groups 204 and the LEDs 116 to illuminate from within the channels 410 through the openings, as disclosed herein.

The channel groups 204 have the channels 410, each one having an inner surface defining that respective channel 410. For example, each of the channel groups 204 has three channels, i.e., a first channel 410 with a first inner surface, a second channel 410 with a second inner surface, and a third channel 410 with a third inner surface. Each of the inner surfaces forms a chamfer 408 sloping (e.g., equal to or less than about 90 degree of a vertical axis) in a direction away from its respective LED 116 and its respective brim 108. The chamber 408 can be smooth, textured, optically reflective, or optically non-reflective. For example, the channel 410 with the chamfer 408 may be forming an optical socket from in which a respective LED 116 is nested below the outer surface (e.g., between about 10 millimeters and about 20 millimeters) and from which the respective LED 116 illuminates. Note that the chamfer 408 can be omitted. Further, note that some channels 410 may not have the chamfer 408 and some channels 410 may have the chamfer 410. Also, note that although the chamfer 408 is positioned underneath a respective LED 116, this is not required and the chamfer can be lateral or positioned above that respective LED 116, whether additionally or alternatively. Whether the chamfer 408 is included or omitted, the LEDs 116 can respectively illuminate from within (e.g., nested) the first channel 410, the second channel 410, or the third channel 410 based on a respective reflection off the first inner surface of the first channel 410, the second inner surface of the second channel 410, or the third inner surface of the third channel 410.

The louver board 106 has the outer surface forming an accordion pattern thereon. The accordion pattern is defined by a plurality of valleys 406 and a plurality of ridges 404 extending between each other. As such, the channel groups 204 have the first opening of the first channel 410, the second opening of the second channel 410, and the third opening of the third channel 410 interrupting at least two of the valleys 406 or at least two of the ridges 404. As shown in FIG. 5, interruption can enable the channels 410 that are positioned vertically one above another to be not connected to each other. In contrast, as shown in FIG. 6, this interruption is missing and therefore enables the channels 410 that are positioned vertically one above another to be connected to each other.

The louver board 106 is monolithic, but can be assembled (e.g., mated, fastened, jigsaw puzzle). The louver board 106 includes a non-glass filled polycarbonate, but can include any other suitable material (e.g., glass filled polycarbonate, plastic, metal, rubber, glass, wood). The brims 108 are monolithic with the louver board 106 (e.g., injection molding, subtractive manufacturing), but can be assembled with the louver board 106 (e.g., fastened, mated, magnetized, adhered). At least two of the brims 108 that are horizontally consecutive can be monolithic with each other (e.g., injection molding, subtractive manufacturing), but can be assembled with each other (e.g., fastened, mated, magnetized, adhered).

Figure 7:
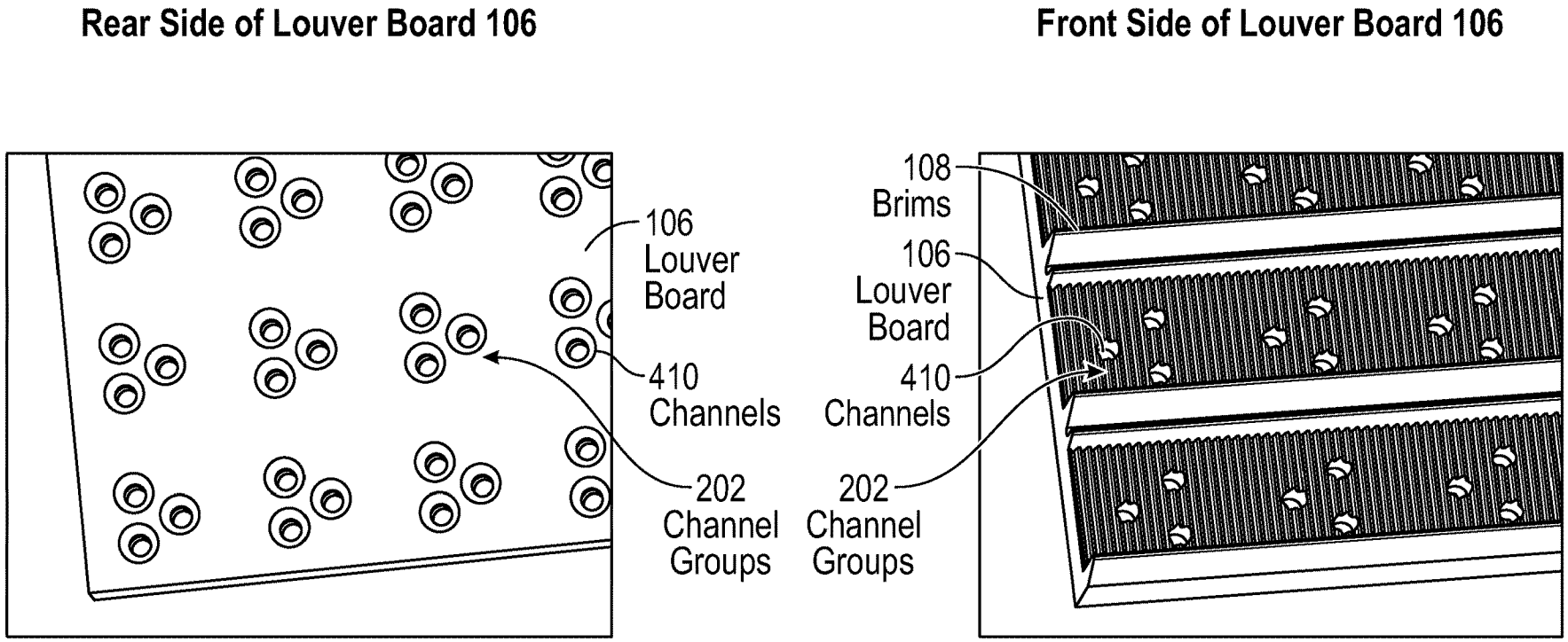
FIG. 7 shows a plurality of perspective views of an embodiment of a louver board according to this disclosure.

FIG. 7 shows a plurality of perspective views of an embodiment of a louver board according to this disclosure. In particular, the louver board 106 has a front outer surface (e.g., exposed to the Sun, visible to pedestrians) and a rear outer surface, as disclosed herein. The louver board 106 forms the channel groups 202 therein, where each of the channel groups 202 has the channels 410 spanning between the front outer surface and the rear outer surface, as disclosed herein. The front outer surface has the brims 108 extending therefrom, as disclosed herein.

Figure 8:
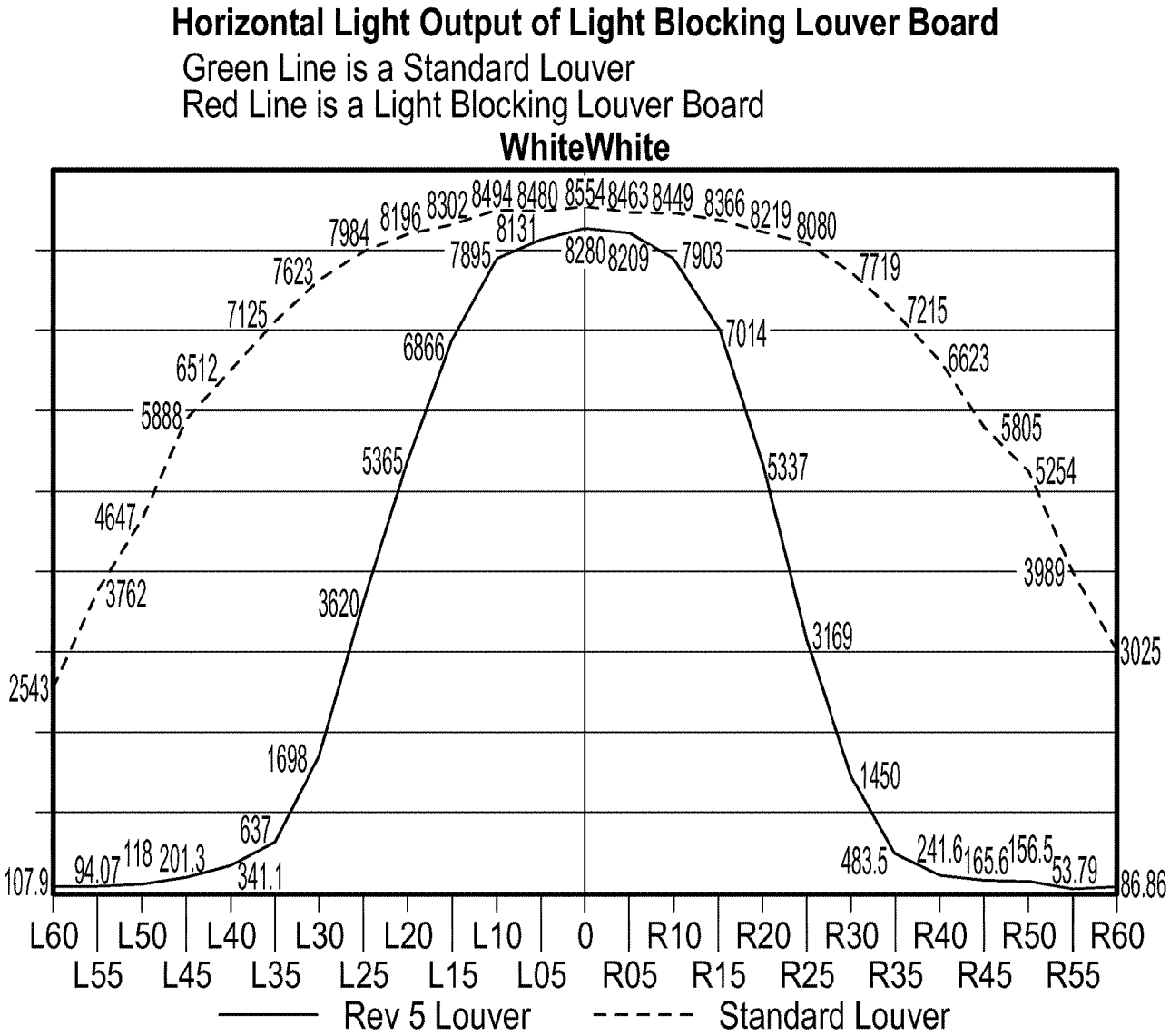
FIG. 8 shows a diagram of an embodiment of a louver board, where the diagram is informative of a plurality of directed illumination properties according to this disclosure.

FIG. 8 shows a diagram of an embodiment of a louver board, where the diagram is informative of a plurality of directed illumination properties according to this disclosure. In particular, the diagram corresponds to the louver board 106 that directs illumination from the LEDs 116, as disclosed. The diagram has an X-axis corresponding to a frontal viewing angle (degrees) and a Y-axis corresponding to a brightness measurement (candela per square or nits). Resultantly, a sign that has (a) the LEDs 116 being nested, as disclosed herein, and (b) the louver board 106 being configured, as disclosed herein, is able to block more light than a conventional sign.

Figure 9:
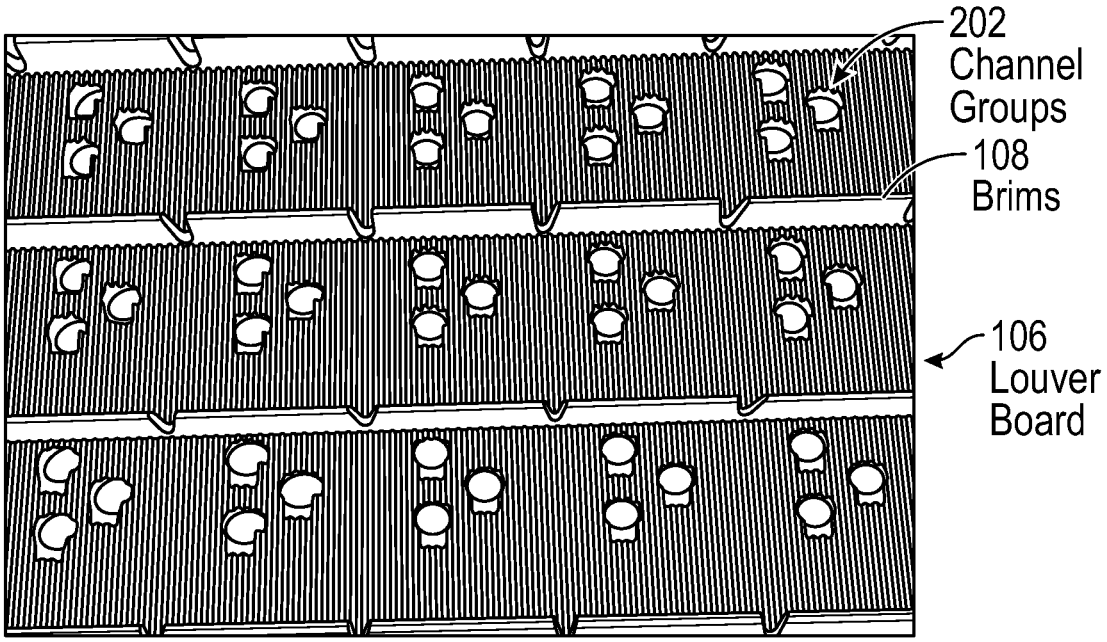
FIG. 9 shows a frontal view of an embodiment of a louver board according to this disclosure.

FIG. 9 shows a frontal view of an embodiment of a louver board according to this disclosure. In particular, the louver board 106 is shown frontally, with the front outer surface, as disclosed herein.

Note that the sign can be secured (e.g., mated, fastened) to an outdoor fixture (e.g., pole, platform, building, frame) or a vehicle (e.g., land, marine, aerial) or an indoor fixture (e.g., wall, platform, frame, furniture) and then illuminated while secured to the outdoor fixture or the vehicle or the indoor fixture. Likewise, the sign or any components thereof can be packaged, whether alone or with any others, whether disclosed herein or not, in a kit. For example, the kit can include a package (e.g. plastic bag, sealed bag, storage container, cardboard box, transport package, consumer package, bubble wrap, foam blanket, garment blanket, can, shrink-wrap, molded pulp, blister pack). For example, the package can include a cuboid box, a shipping box, an intermodal container, or others. The package can include the sign or any components thereof.

As used herein, a term "or others," "combination", "combinatory," or "combinations thereof" refers to all permutations and combinations of listed items preceding that term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. Skilled artisans understand that typically there is no limit on number of items or terms in any combination, unless otherwise apparent from the context.

Features described with respect to certain example embodiments can be combined and sub-combined in or with various other example embodiments. Also, different aspects or elements of example embodiments, as disclosed herein, can be combined and sub-combined in a similar manner as well. Further, some example embodiments, whether individually or collectively, can be components of a larger system, wherein other procedures can take precedence over or otherwise modify their application. Additionally, a number of steps can be required before, after, or concurrently with example embodiments, as disclosed herein. Note that any or all methods or processes, at least as disclosed herein, can be at least partially performed via at least one entity in any manner.

Example embodiments of this disclosure are described herein with reference to illustrations of idealized embodiments (and intermediate structures) of this disclosure. As such, variations from various illustrated shapes as a result, for example, of manufacturing techniques or tolerances, are to be expected. Thus, various example embodiments of this disclosure should not be construed as necessarily limited to various particular shapes of regions illustrated herein, but are to include deviations in shapes that result, for example, from manufacturing.

Any or all elements, as disclosed herein, can be formed from a same, structurally continuous piece, such as being unitary, or be separately manufactured or connected, such as being an assembly or modules. Any or all elements, as disclosed herein, can be manufactured via any manufacturing processes, whether additive manufacturing, subtractive manufacturing, or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Various corresponding structures, materials, acts, and equivalents of all means or step plus function elements in various claims below are intended to include any structure, material, or act for performing the function in combination with other claimed elements as specifically claimed. Various embodiments were chosen and described in order to best disclose various principles of this disclosure and various practical applications thereof, and to enable others of ordinary skill in a pertinent art to understand this disclosure for various embodiments with various modifications as are suited to a particular use contemplated.

This detailed description has been presented for various purposes of illustration and description, but is not intended to be fully exhaustive or limited to this disclosure in various forms disclosed. Many modifications and variations in techniques and structures will be apparent to those of ordinary skill in an art without departing from a scope and spirit of this disclosure as set forth in various claims that follow. Accordingly, such modifications and variations are contemplated as being a part of this disclosure. Scope of this disclosure is defined by various claims, which include known equivalents and unforeseeable equivalents at a time of filing of this disclosure.

What is claimed is:

1. An outdoor sign comprising:

a sign module including:

a tray;

a circuit board hosting an array of illumination groups, wherein each of the illumination groups contains a first light source, a second light source, and a third light source that are optically different from each other; and a louver board hosting an array of channel groups and an array of brims, wherein the circuit board extends between the tray and the louver board, wherein each of the channel groups contains a first channel extending away from each of the circuit board and the tray, a second channel extending away from each of the circuit board and the tray, and a third channel extending away from each of the circuit board and the tray, wherein the array of brims is arranged in a brim grid having a plurality of rows of the brims being spaced apart from each other in the rows and a plurality of columns of the brims being spaced apart from each other in the columns, wherein at least one of the brims in at least one of the rows of the brim grid is horizontally positioned between at least two of the brims in the at least one of the rows of the brim grid, wherein each channel group of the array of channel groups is non-linearly arranged or includes at least two rows of channels, wherein at least one of the brims is vertically positioned between at least two of the channel groups, wherein at least one of the channel groups is vertically positioned between at least two of the brims, wherein the brims are configured to one-to-one shade the channel groups, wherein the first light source is configured to illuminate from within the first channel, wherein the second light source is configured to illuminate from within the second channel, wherein the third light source is configured to illuminate from within the third channel.

2. The outdoor sign of claim 1, wherein the first light source sources a blue light, wherein the second light sources a red light, wherein the third light sources a green light.

3. The outdoor sign of claim 1, wherein at least one of the illumination groups has the first light source, the second light source, and the third light source arranged in a triangular manner such that the first light source, the second light source, and the third light source function as a plurality of corresponding vertices.

4. The outdoor sign of claim 1, wherein at least one of the illumination groups has the first light source, the second light source, and the third light source arranged in a non-triangular manner.

5. The outdoor sign of claim 1, wherein at least one of the channel groups has the first channel, the second channel, or the third channel forming a chamfer sloping in a direction away from its respective light source and its respective brim.

6. The outdoor sign of claim 1, wherein the louver board has an outer surface with an accordion pattern defined by a plurality of valleys and a plurality of ridges, wherein the first channel, the second channel, or the third channel interrupts at least two of the valleys or at least two of the ridges.

7. The outdoor sign of claim 1, wherein the brims are monolithic with the louver board.

8. The outdoor sign of claim 1, wherein at least two of the brims are horizontally consecutive and are monolithic with each other.

9. The outdoor sign of claim 1, wherein the tray is fastened to the louver board.

10. The outdoor sign of claim 9, wherein the tray is fastened to the louver board through the circuit board.

11. The outdoor sign of claim 1, wherein the louver board includes a non-glass filled polycarbonate.

12. The outdoor sign of claim 1, wherein the first light source, the second light source, or the third light source is configured to respectively illuminate from within the first channel, the second channel, or the third channel based on a respective reflection off the first channel, the second channel, or the third channel.

13. The outdoor sign of claim 1, wherein at least two of the first channel, the second channel, or the third channel are connected to each other.

14. The outdoor sign of claim 1, wherein at least two of the first channel, the second channel, or the third channel are not connected to each other.

15. A method comprising:

extending a circuit board between a tray and a louver board, wherein the circuit board, the tray, and the louver board are included in a sign module, wherein the circuit board hosts an array of illumination groups, wherein each of the illumination groups contains a first light source, a second light source, and a third light source that are optically different from each other, wherein the louver board hosts an array of channel groups and an array of brims, wherein each of the channel groups contains a first channel extending away from each of the circuit board and the tray, a second channel extending away from each of the circuit board and the tray, and a third channel extending away from each of the circuit board and the tray, wherein the array of brims is arranged in a brim grid having a plurality of rows of the brims being spaced apart from each other in the rows and a plurality of columns of the brims being spaced apart from each other in the columns, wherein at least one of the brims in at least one of the rows of the brim grid is horizontally positioned between at least two of the brims in the at least one of the rows of the brim grid, wherein each channel group of the array of channel groups is non-linearly arranged or includes at least two rows of channels, wherein at least one of the brims is vertically positioned between at least two of the channel groups, wherein at least one of the channel groups is vertically positioned between at least two of the brims, wherein the brims are configured to one-to-one shade the channel groups, wherein the first light source is configured to illuminate from within the first channel, wherein the second light source is configured to illuminate from within the second channel, wherein the third light source is configured to illuminate from within the third channel; and securing the louver board and the tray to each other such that the circuit board is interposed therebetween.

16. The method of claim 15, wherein at least one of the illumination groups has the first light source, the second light source, and the third light source arranged in a triangular manner such that the first light source, the second light source, and the third light source function as a plurality of corresponding vertices.

17. The method of claim 15, wherein at least one of the channel groups has the first channel, the second channel, or the third channel forming a chamfer sloping in a direction away from its respective light source and its respective brim.

18. The method of claim 15, wherein the first light source, the second light source, or the third light source is configured to respectively illuminate from within the first channel, the second channel, or the third channel based on a respective reflection off the first channel, the second channel, or the third channel.

19. A method comprising:

causing a sign to be secured to an outdoor fixture, wherein the sign includes a sign module including a tray, a circuit board, and a louver board, wherein the circuit board hosts an array of illumination groups, wherein each of the illumination groups contains a first light source, a second light source, and a third light source that are optically different from each other, wherein the louver board hosts an array of channel groups and an array of brims, wherein the circuit board extends between the tray and the louver board, wherein each of the channel groups contains a first channel extending away from each of the circuit board and the tray, a second channel extending away from each of the circuit board and the tray, and a third channel extending away from each of the circuit board and the tray, wherein the array of brims is arranged in a brim grid having a plurality of rows of the brims being spaced apart from each other in the rows and a plurality of columns of the brims being spaced apart from each other in the columns, wherein at least one of the brims in at least one of the rows of the brim grid is horizontally positioned between at least two of the brims in the at least one of the rows of the brim grid, wherein each channel group of the array of channel groups is non-linearly arranged or includes at least two rows of channels, wherein at least one of the brims is vertically positioned between at least two of the channel groups, wherein at least one of the channel groups is vertically positioned between at least two of the brims, wherein the brims are configured to one-to-one shade the channel groups, wherein the first light source is configured to illuminate from within the first channel, wherein the second light source is configured to illuminate from within the second channel, wherein the third light source is configured to illuminate from within the third channel; and causing the illumination groups to illuminate while the sign is secured to the outdoor fixture.

20. The method of claim 19, wherein at least one of the illumination groups has the first light source, the second light source, and the third light source arranged in a triangular manner such that the first light source, the second light source, and the third light source function as a plurality of corresponding vertices.

21. The method of claim 19, wherein at least one of the channel groups has the first channel, the second channel, or the third channel forming a chamfer sloping in a direction away from its respective light source and its respective brim.

22. The method of claim 19, wherein the first light source, the second light source, or the third light source is configured to respectively illuminate from within the first channel, the second channel, or the third channel based on a respective reflection off the first channel, the second channel, or the third channel.

23. A signage unit comprising:

a sign module including:

a tray;

a circuit board hosting an array of illumination groups, wherein each of the illumination groups contains a plurality of light sources; and a louver board hosting an array of channel groups and an array of brims, wherein the circuit board extends between the tray and the louver board, wherein each of the channel groups contains a plurality of channels each extending away from each of the circuit board and the tray, wherein the array of brims is arranged in a brim grid having a plurality of rows of the brims being spaced apart from each other in the rows and a plurality of columns of the brims being spaced apart from each other in the columns, wherein at least one of the brims in at least one of the rows of the brim grid is horizontally positioned between at least two of the brims in the at least one of the rows of the brim grid, wherein each channel group of the array of channel groups is non-linearly arranged or includes at least two rows of channels, wherein at least one of the brims is vertically positioned between at least two of the channel groups, wherein at least one of the channel groups is vertically positioned between at least two of the brims, wherein the brims are configured to one-to-one shade the channel groups, wherein the light sources are configured to illuminate from within the channels.

* * * * *